US006352493B1

(12) United States Patent
Davis

(10) Patent No.: US 6,352,493 B1
(45) Date of Patent: Mar. 5, 2002

(54) SWIMMING SIMULATION SYSTEM

(76) Inventor: James Davis, 914 Wynne Wood Rd., Apt. 2H, Pelham Manor, NY (US) 10803

( * ) Notice: Subject to any disclaimer, the term of this patent is extended or adjusted under 35 U.S.C. 154(b) by 0 days.

(21) Appl. No.: 09/650,085

(22) Filed: Aug. 29, 2000

(51) Int. Cl.[7] ..... A63B 69/10
(52) U.S. Cl. ..... 482/56; 434/254
(58) Field of Search ..... 482/55, 56, 148, 482/111, 112, 51, 63; 434/254

(56) References Cited

U.S. PATENT DOCUMENTS 1,316,524 A * 9/1919 Watts
2,013,520 A * 9/1935 McDermott ..... 272/71
2,019,224 A * 10/1935 Hess
3,791,646 A * 2/1974 Marchignoni ..... 482/56
4,674,740 A * 6/1987 Iams et al. ..... 482/56
5,158,513 A * 10/1992 Reeves ..... 482/56

* cited by examiner

*Primary Examiner*—Stephen R. Crow

(57) ABSTRACT

A swimming simulation system comprises a base assembly including an elongated central section with a front edge and with a parallel rear edge and long parallel side edges there between the base assembly. Also included is a generally v-shaped section, with legs extending upwardly with interior slopping faces extending upwardly. A table is provided in a generally horizontal orientation having an upper surface to receive the user and a lower surface with a table support block secured to the upper surface of the central section and supporting the table. Lastly provided are an upper air cylinder and a lower air cylinder, each having a ball joint coupled to each associated interior sloping face. Each air cylinder has a reciprocable rod and a hand-receiving loop coupled to the exterior ends of the reciprocable rods.

8 Claims, 6 Drawing Sheets

FIG 2
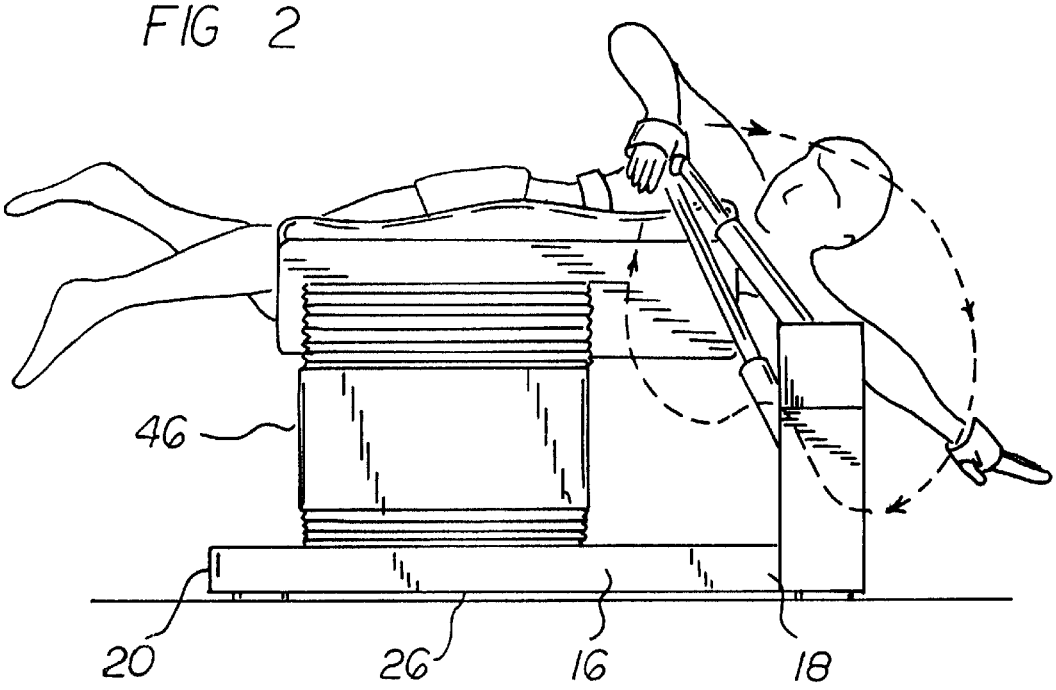
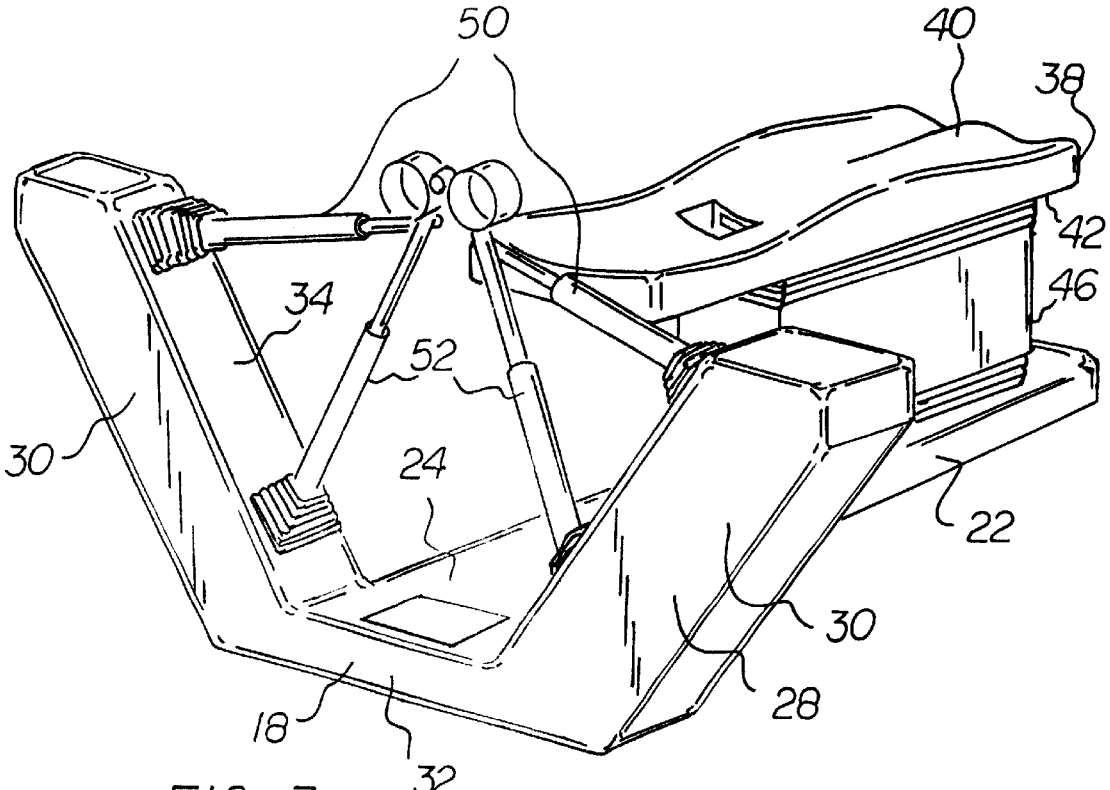
FIG 3

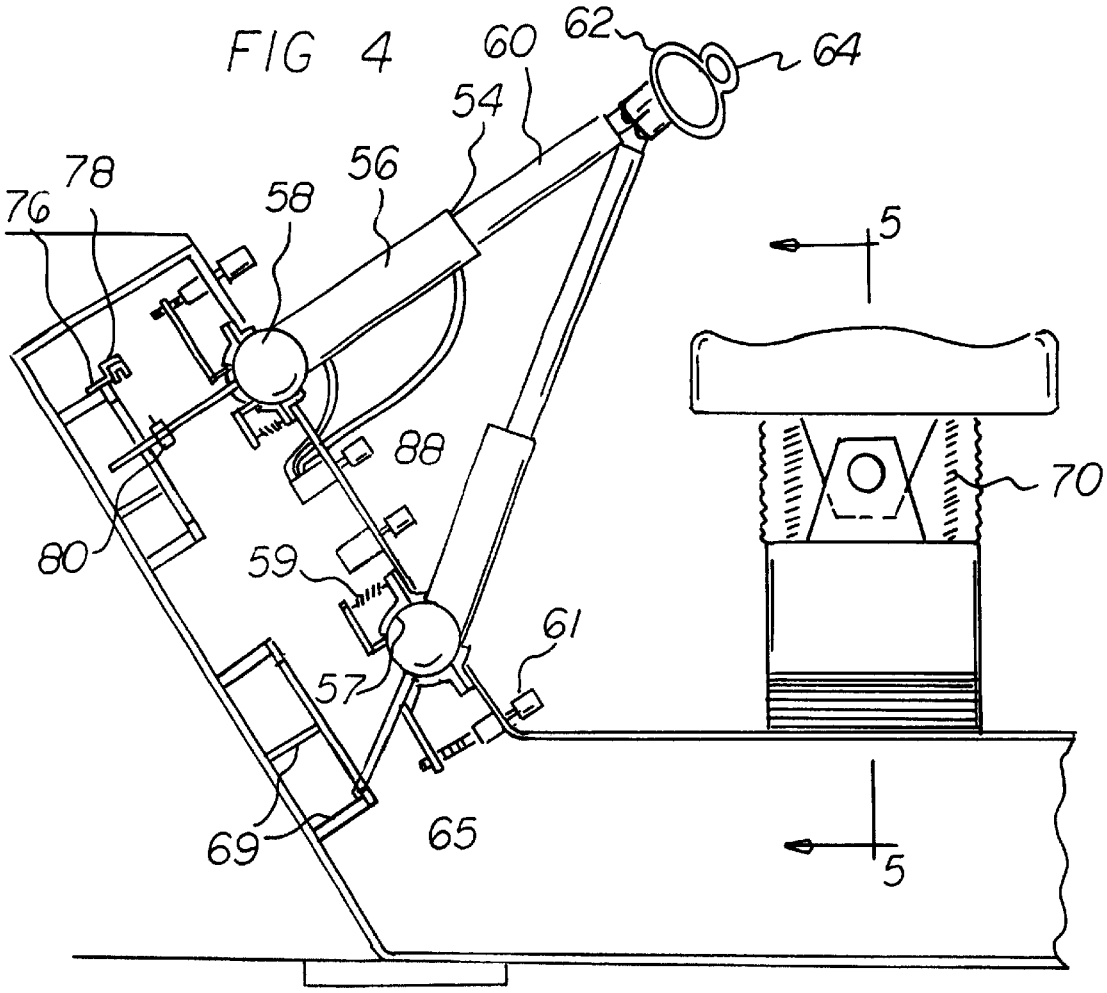
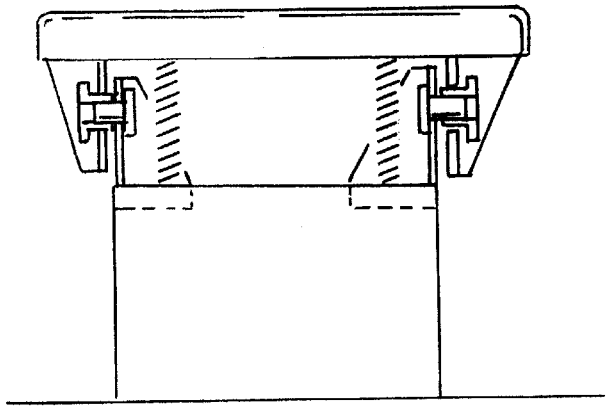
FIG 5

FIG 7A
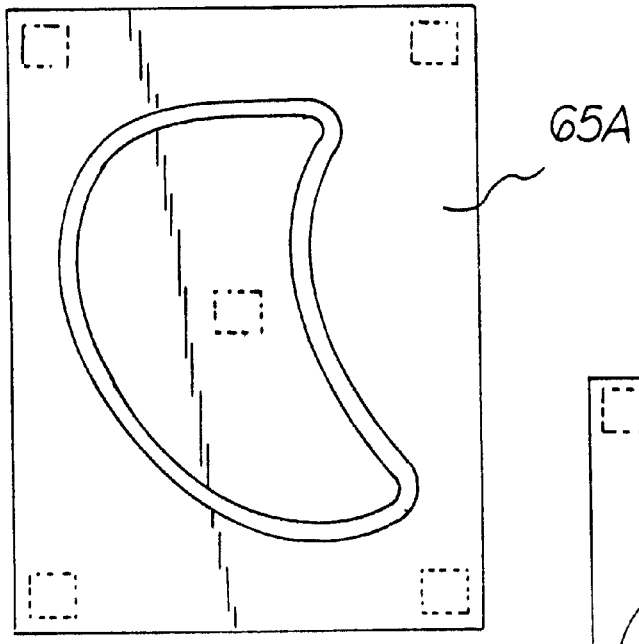
FIG 7B
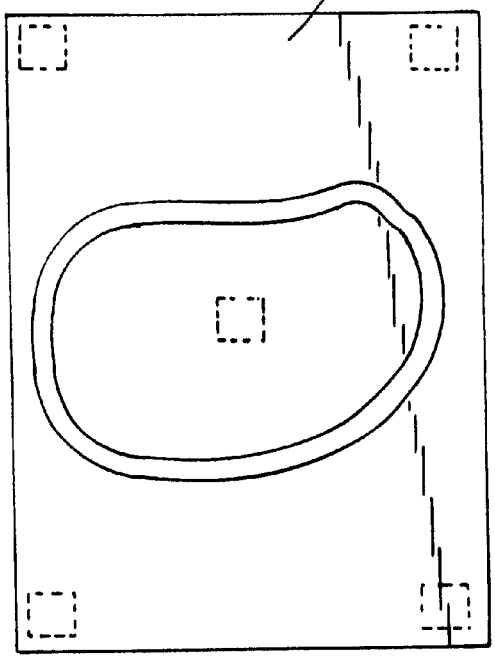
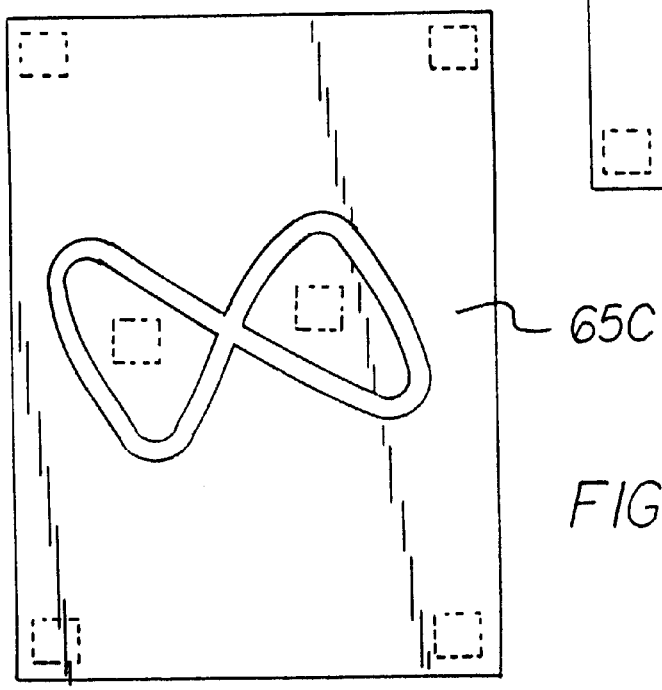
FIG 7C

FIG 8
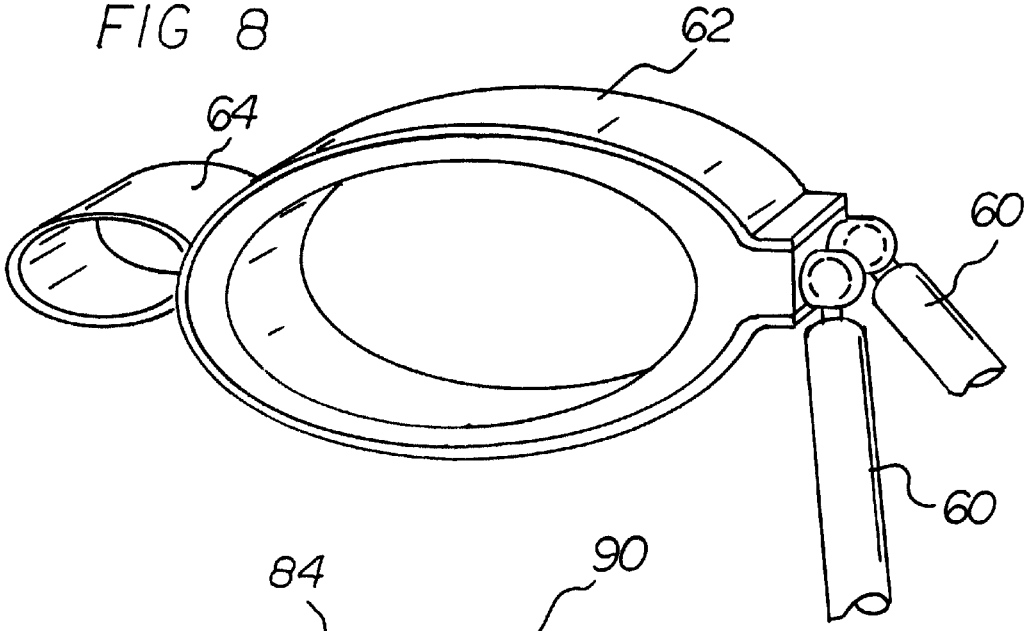
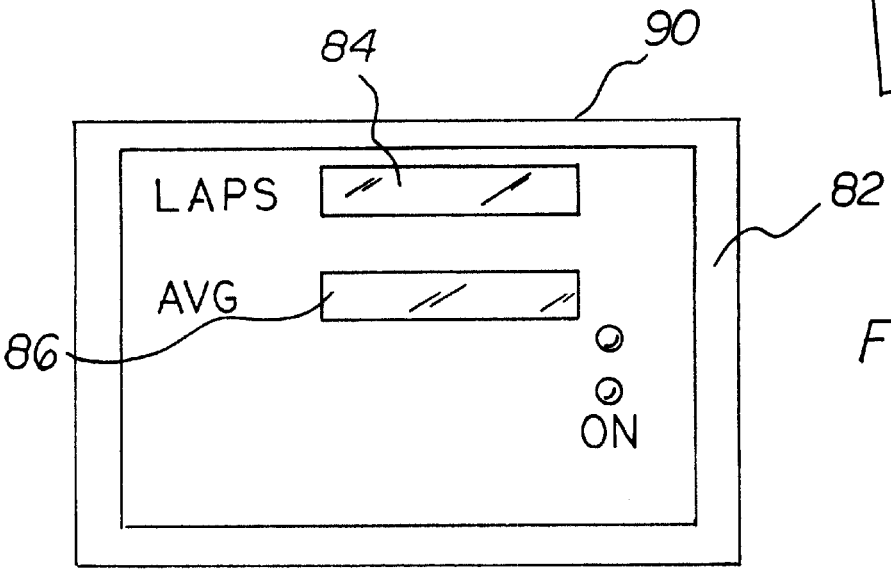
FIG 9
FIG 10
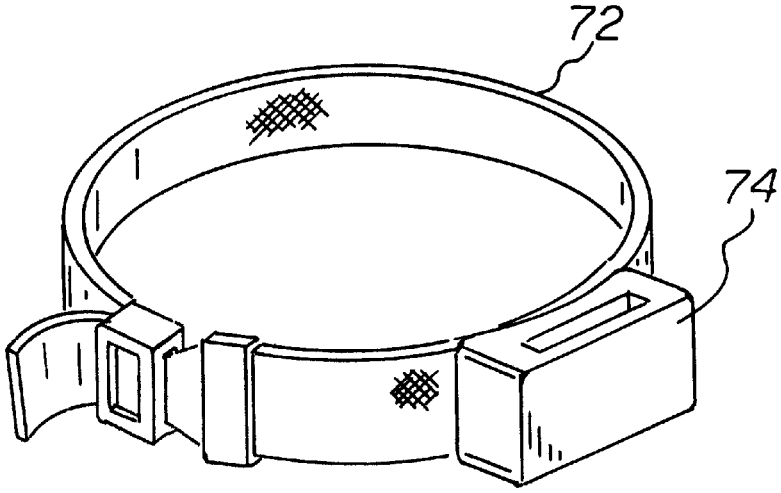

SWIMMING SIMULATION SYSTEM

BACKGROUND OF THE INVENTION

1. Field of the Invention

The present invention relates to a swimming simulation system and more particularly pertains to allowing swimmers to exercise and train out of the water while being able to monitor their progress on a computer display and provides a sculling action to strengthen those muscles used to scull.

2. Description of the Prior Art

The use of swimming aids of known designs and configurations is known in the prior art. More specifically, swimming aids of known designs and configurations previously devised and utilized for the purpose of permitting athletes such as swimmers to exercise and train are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,707,320 to Huei-Nan Yu discloses a Swimming exerciser. U.S. Pat. No. 5,603,676 to Kenneth J. Cymbalisty discloses a Crawl Swim Exerciser. U.S. Pat. No. 5,518,472 to Paul Chen discloses a swimming exerciser. U.S. Pat. No. 5,429,564 to Michael P. Doane discloses an exercising apparatus. U.S. Pat. No. 4,830,363 to Robert J. Kennedy discloses a dry land swimming training apparatus. U.S. Pat. No. 4,674,740 to John F. Iams and Robson L. Splane, Jr. discloses a exercise machine for simulating swimming motions. U.S. Pat. No. 5,376,060 to John J. Murray discloses a swimming simulator. U.S. Pat. No. 4,422,634 to Harry C. Hopkins discloses a swimming simulator. U.S. Pat. No. 5,282,748 to Oscar L. Little discloses a swimming simulator. Lastly, U.S. Pat. No. 3,074,716 to Carl E. Mitchel and George F. Mitchel discloses a swimming instructing machine and exerciser.

While these devices fulfill their respective, particular objectives and requirements, the aforementioned patents do not describe swimming simulation system that allows allowing swimmers to exercise and train out of the water while being able to monitor their progress on a computer display.

In this respect, the swimming simulation system according to the present invention substantially departs from the conventional concepts and designs of the prior art, and in doing so provides an apparatus primarily developed for the purpose of allowing swimmers to exercise and train out of the water while being able to monitor their progress on a computer display.

Therefore, it can be appreciated that there exists a continuing need for a swimming simulation system which can be used for allowing swimmers to exercise and train out of the water while being able to monitor their progress on a computer display. In this regard, the present invention substantially fulfills this need.

SUMMARY OF THE INVENTION

In view of the foregoing disadvantages inherent in the known types of swimming aids of known designs and configurations now present in the prior art, the present invention provides an improved swimming simulation system. As such, the general purpose of the present invention, which will be described subsequently in greater detail, is to provide a swimming simulation system and method which has all the advantages of the prior art and none of the disadvantages.

To attain this, the present invention essentially comprises a swimming simulation system. First provided is a base assembly. The base assembly includes an elongated central section in a rectangular configuration with a short front edge and a short parallel rear edge. The base assembly also has long parallel side edges between the front and rear edges. The base assembly also includes a planar upper surface and a planar lower surface with a generally v-shaped section. Legs extend upwardly from adjacent to the front edge of the central section. The v-shaped section has a central portion as an extension of the central section. Interior slopping faces extend upwardly from the central portion at angles of about 60 degrees from the horizontal. Next provided as part of the system is a table in a generally horizontal orientation. The table has an upper contoured surface to receive the torso of a user. The lower surface is overlying and supported above the central section intermediate to the front and rear edges of the central section. Next provided is a table support block in a rectangular configuration secured to the upper surface of the central section. The support block is spaced rearwardly of the v-shaped section. The support block functions to support the table. An upper air cylinder and a lower air cylinder are next provided. Each air cylinder has an exterior end and an interior end with a ball joint coupled to each associated interior sloping face for universal rotation. Each air cylinder has a reciprocable rod extending from within the exterior end of Its associated air cylinder. Coupled to the exterior ends of the reciprocable rods on each sloping face is a hand-receiving loop with an associated thumb-receiving loop. Next provided is a template beneath each ball joint constituting a template set for a particular stroke and with a slot through each template corresponding in shape to the arm movements of a particular swimming stroke with a finger secured to the ball joint extending through the slot to ensure proper arm movement of a user. Next provided is a horizontal pivot pin. The horizontal pivot pin couples the table and the table support block to allow for lateral pivoting of the table with respect to the table support. Laterally positioned springs Lo are provided to control the pivoting of the table with respect to the table support. The table also has a strap with an associated clamp to releasably retain the user on the table during operation and use. Lastly provided is a control assembly. The control assembly includes sensors operatively coupled with respect to each finger and a fixed portion of the housing. A display panel is provided on the upper surface of the base assembly between the legs of the v-shaped section within view of a user. The display panel allows the user to view the number of "laps," and an "average" as a function of the rate of triggering of a sensor on a slot by a finger when a user moves through a full range of motion. Lastly provided is a computer system. The computer system functions to read the output from the sensors to effect a proper display.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a swimming simulation system which has all of the advantages of the prior art swimming aids of known designs and configurations and none of the disadvantages.

It is another object of the present invention to provide a swimming simulation system which may be easily and efficiently manufactured and marketed.

It is further object of the present invention to provide a swimming simulation system which is of durable and reliable constructions.

An even further object of the present invention is to provide a swimming simulation system which is susceptible of a low cost of manufacture with regard to both materials and labor, and which accordingly is then susceptible of low prices of sale to the consuming public, thereby making such swimming simulation system economically available to the buying public.

Even still another object of the present invention is to provide a swimming simulation system for allowing swimmers to exercise and train out of the water while being able to monitor their progress on a computer display.

Lastly, it is an object of the present invention to provide a swimming simulation system comprising a base assembly including an elongated central section with a front edge and with a parallel rear edge and long parallel side edges there between the base assembly. Also included is a generally v-shaped section, with legs extending upwardly with interior slopping faces extending upwardly. A table is provided in a generally horizontal orientation having an upper surface to receive a user and a lower surface with a table support block secured to the upper surface of the central section and supporting the table. Lastly provided are an upper air cylinder and a lower air cylinder, each having a ball joint coupled to each associated interior sloping face. Each air cylinder has a reciprocable rod and a hand-receiving loop coupled to the exterior ends of the reciprocable rods.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the system shown in FIG. 1.

FIG. 3 is a perspective illustration of the system shown in FIGS. 1 and 2 but without a swimmer on the table.

FIG. 4 is a front elevational view partly in cross section taken in the lower left portion of FIG. 1.

FIG. 5 is a cross sectional view taken along line 5.5 in FIG. 4.

FIG. 7A is a plan view of a template for the butterfly stroke.

FIG. 7B is a plan view of a template for the breast stroke.

FIG. 7C is a plan view of a template for a back stroke.

FIG. 8 is a enlarged perspective showing of the loops for the user's hand and thumb.

FIG. 9 is a front elevational view of the computer readout.

FIG. 10 is a perspective illustration of the user's belt in associated coupling mechanisms.

The same reference numerals refer to the same parts throughout the various Figures.

DESCRIPTION OF THE PREFERRED EMBODIMENT

Figure 1:
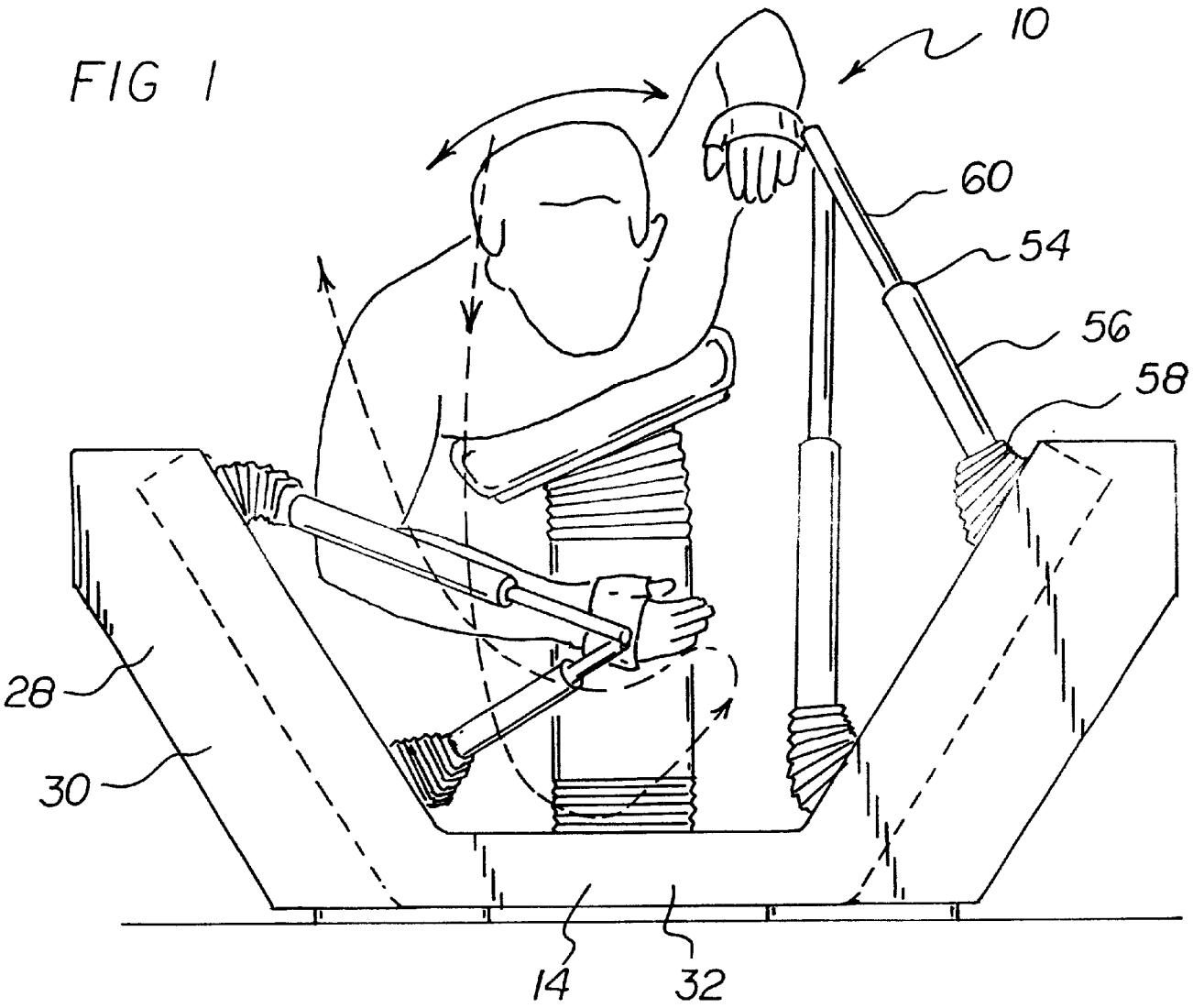
FIG. 1 is a front elevational view of the swimming simulation system constructed in accordance with principles of the present invention.
Figure 6:
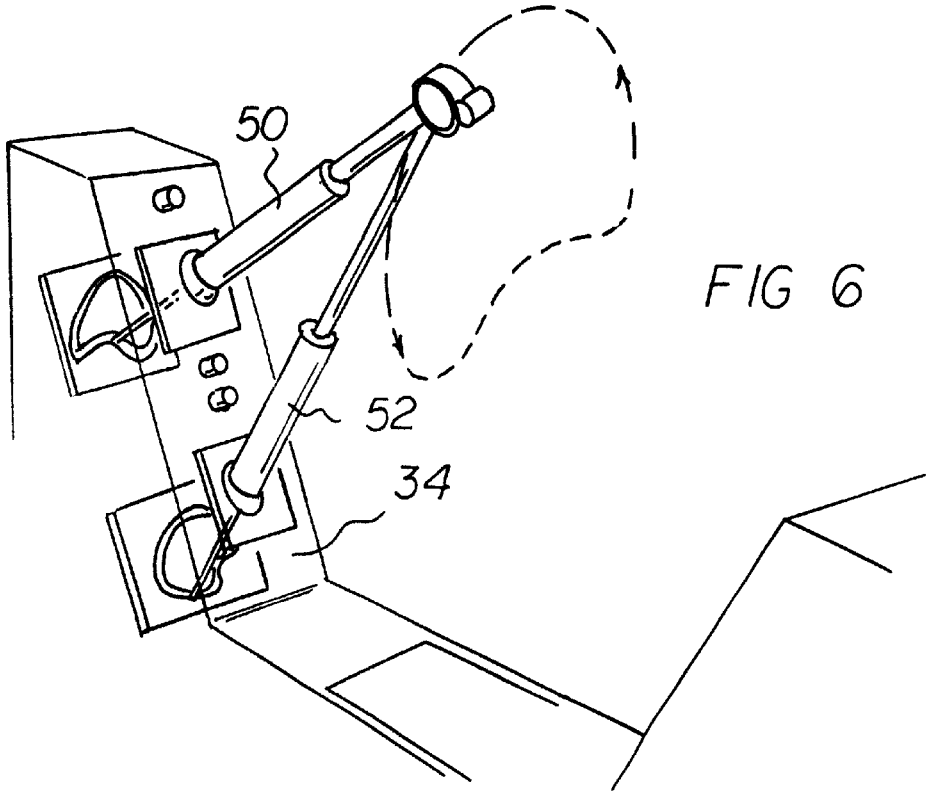
FIG. 6 is a perspective illustration of the lefthand portion of FIG. 3 with parts removed to show certain internal constructions thereof.

With reference now to the drawings, and in particular to FIGS. 1 through 10 thereof, the preferred embodiment of the swimming simulation system embodying the principles and concepts of the present invention and generally designated by the reference numeral 10 will be described.

The present invention, the swimming simulation system 10 is comprised of a plurality of components. Such components in their broadest context include a base assembly, a table, a table support block, an upper air cylinder and a lower air cylinder. Such components are individually configured and correlated with respect to each other so as to attain the desired objective.

The swimming simulation system 10 of the present invention is for allowing swimmers to exercise and train out of the water while being able to monitor their progress on a computer display.

First provided is a base assembly 14. The base assembly includes an elongated central section 16 in a rectangular configuration. It includes a short front edge 18 and a short parallel rear edge 20. It also includes long parallel side edges 22 between the front and rear edges. The base assembly has a planar upper surface 24 and a planar lower surface 26. The base assembly also includes a generally v-shaped section 28. The v-shaped section has legs 30. The legs extend upwardly from adjacent to the front edge of the central section 32. The v-shaped section has a central portion which is formed as an extension of the central section. Interior slopping faces 34 extend upwardly from the central portion at angles of about 60 degrees from the horizontal.

Next provided is a table 38 in a generally horizontal orientation. The table has an upper contoured surface 40 to comfortably receive the torso of a user. The lower surface 42 is overlying and supported above the central section at a location intermediate to the front and rear edges of the central section.

A table support block 46 is next provided. Such block is formed in a rectangular configuration. This block is secured to the upper surface of the central section. The support block is spaced rearwardly of the v-shaped section and functions to supports the table.

An upper air cylinder 50 and a lower air cylinder 52 are next provided. Each air cylinder has an exterior end 54 and an Ad interior end 56. A ball joint 58 is coupled to each associated interior sloping face for universal rotation between the cylinders and the interior sloping faces. Plates 57 support the ball joints with spring supports 59 and adjustors 61. Each air cylinder has a reciprocable rod 60 extending from within the exterior end of its associated air cylinder. Coupled to the exterior ends of the reciprocable rods on each sloping face is a hand-receiving loop 62 with an associated thumb-receiving loop 64.

Figure 7:
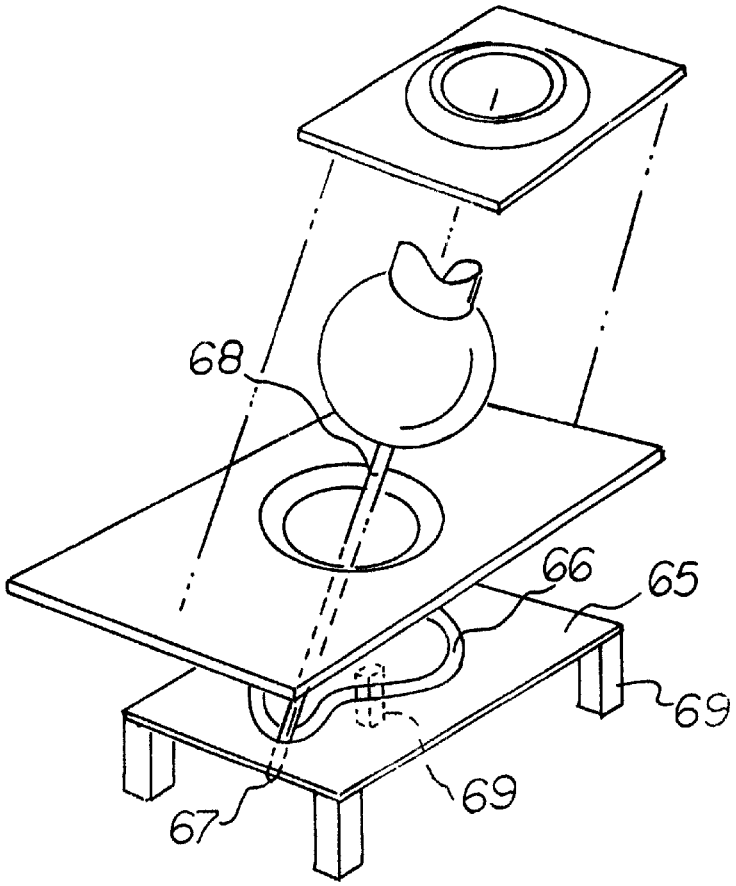
FIG. 7 is a exploded perspective view of the universal joint with a template for the freestyle stroke.

Next provided is a template 65 beneath each ball joint constituting a template set for a particular stroke and with a slot 66 through each template corresponding in a shape corresponding to the preferred arm movement of a particular swimming stroke. A is finger 67 secured to the ball joint extending downwardly through the slot of the template to ensure proper arm movements of a user. In use each system would include four template sets, each set having four templates, one for each ball joint. One set would be for each stroke: a template 65A in a kidney configuration for the butterfly stroke as shown in Figure A, a template 65B in a generally oval configuration for the breaststroke as shown in FIG. 7B, a template 65C in a FIG. 8 configuration for the backstroke as shown in FIG. 7C, and a template in a generally triangular configuration for the freestyle or crawl stroke as shown in FIG. 7. Each shown template is for one arm, but it is understood that a corresponding template in a mirror image configuration would be provided for the other arm. Additionally, posts 69 beneath the templates provide space there beneath for the movement of the fingers 68.

Next provided is a horizontal pivot pin 68. The horizontal pivot pin couples the table and the table support block. It functions to allow for lateral pivoting of the table with respect to the table support. Laterally positioned springs 70 are provided. The springs function to control the pivoting of the table with respect to the table support. The table also has a strap 72 with an associated clamp 74 functioning to releasably retain a user on the table during operation and use.

Lastly provided is a control assembly 76. The control assembly includes a Hall effect magnetic sensor 78, 80 operatively coupled with respect to each finger and a fixed portion of the housing to respond as a result of the movement of the ball joints individually. A display panel 82 is provided on the upper surface of the base assembly. It is preferably located between the legs of the v-shaped section within view of a user. The display panel allows a user to display duration as "laps" 84 and speed as "average" 86 as a function of the rate of triggering of sensors 88 following the motion of the air cylinders 50 when the user moves through a full range of motion.

Lastly, a computer system 90 is provided. The computer system functions to read the output from the sensors 88 to effect a proper display.

The present invention has utility in allowing swimmers to exercise and train out of the water while being able to monitor their progress on a computer display. The action of the present invention includes a sculling action, side-to-side, and allows strengthening those muscles to scull. The action of the prior art is front-to-back and does not target the necessary muscle training. The prior art does not address the concept of sculling, i.e., lift drag in water. Additionally, with the use of different templates, specific muscles can be targeted. The present invention also has utility as an aid in physical therapy where the motion and exercise of the shoulders and arms is desired following injury and/or surgery.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A swimming simulation system for allowing swimmers to exercise and train out of the water while being able to monitor their progress on a computer display comprising, in combination:

a base assembly including an elongated central section in a rectangular configuration with a short front edge and with a short parallel rear edge and long parallel side edges there-between and a planar upper surface and a planar lower surface, the base assembly also including a generally v-shaped section, with legs extending upwardly from adjacent to the front edge of the central section, the v-shaped section having a central portion as an extension of the central section with interior sloping faces extending upwardly from the central portion at angles of about 60 degrees from the horizontal;

a table in a generally horizontal orientation having an upper contoured surface to receive the torso of the user and a lower surface overlying and supported above the central section intermediate to the front and rear edges;

a table support block in a rectangular configuration secured to the upper surface of the central section spaced rearwardly of the v-shaped section and supporting the table;

a upper air cylinders and lower air cylinders each having an exterior end and an interior end with a ball joint coupled to each associated interior sloping face for universal rotation, each air cylinder having a reciprocable rod extending from within the exterior end of its associated air cylinder and a hand-receiving loop with an associated thumb-receiving loop coupled to the exterior ends of the reciprocable rods of each sloping face;

a template beneath each ball joint constituting a template set for a particular stroke and with a slot through each template corresponding in shape to the arm movements of a particular swimming stroke with a finger secured to the ball joint extending through the slot to ensure proper arm movements of a user;

a horizontal pivot pin coupling the table and the table support block to allow for lateral pivoting of the table with respect to the table support and with laterally positioned springs to control the pivoting of the table with respect to the table support, the table also having a strap with an associated clamp to releasably retain the user on the table during operation and use; and a control assembly including a Hall effect magnetic sensors operatively coupled with respect to each finger and a fixed portion of the housing and with a display panel on the upper surface of the base assembly between the legs of the v-shaped section within view of the user to display duration as "laps," and speed as "average" as a function of the rate of triggering of a sensor on a loop by a finger when a user moves through a full range of motion and with a computer system to read the output from the sensors to effect a proper display.

2. A swimming simulation system comprising:

a base assembly including an elongated central section with a front edge and with a rear edge and long parallel side edges therebetween, the base assembly also including a generally v-shaped section, with legs extending upwardly with interior sloping faces extending upwardly;

a table in a generally horizontal orientation having an upper surface to receive the user and a lower surface;

a table support block secured to the upper surface of the central section and supporting the table;

upper air cylinders and lower air cylinders each having a ball joint coupled to each associated interior sloping face, each air cylinder having a reciprocable rod and a hand-receiving loop coupled to the exterior ends of the reciprocable rods;

a template beneath each ball joint constituting a template set for a particular stroke and with a slot through each template corresponding in shape to the arm movements of a particular swimming stroke with a finger secured to the ball joint extending through the slot to ensure proper arm movements of a user.

3. The swimming simulation system as set forth in claim 2 and further including:

a horizontal pivot pin coupling the table and the table support block to allow for lateral pivoting of the table with respect to the table support and with laterally positioned springs to control the pivoting of the table with respect to the table support, the table also having a strap with an associated clamp to releasably retain the user on the table during operation and use.

4. The swimming simulation system as set forth in claim 2 and further including:

a control assembly including sensors operatively coupled with respect to each ball joint and with a display panel on the upper surface of the base assembly between the legs of the v-shaped section within view of the user to display "laps," and "average" as a function of the rate of triggering of a sensor on a loop by a rod when a user moves through a full range of motion and with a computer system to read the output from the sensors to effect a proper display.

5. The swimming simulation system as set forth in claim 2 wherein the template is in a triangular configuration for the freestyle stroke.

6. The swimming simulation system as set forth in claim 2 wherein the template is in a kidney configuration for the butterfly stroke.

7. The swimming simulation system as set forth in claim 2 wherein the template is in an oval configuration for the breaststroke.

8. The swimming simulation system as set forth in claim 2 wherein the template is in a FIG. 8 configuration for the back stroke.

* * * * *